US005224818A

United States Patent [19]

Drerup et al.

[11] Patent Number: 5,224,818

[45] Date of Patent: Jul. 6, 1993

[54] AIR TRANSFER BUSHING

[75] Inventors: Vincent M. Drerup, Cincinnati; Harold R. Hansel, Mason, both of Ohio

[73] Assignee: General Electric Company, Cincinnati, Ohio

[21] Appl. No.: 786,678

[22] Filed: Nov. 1, 1991

[51] Int. Cl.[5] ..... F01D 11/02

[52] U.S. Cl. ..... 415/115; 415/116

[58] Field of Search ..... 415/114, 115, 116

[56] References Cited

U.S. PATENT DOCUMENTS

| | | | |
|---|---|---|---|
| 2,836,393 | 5/1958 | Payne et al. | 415/115 |
| 2,914,919 | 12/1959 | Varadi | 60/39.31 |
| 3,228,186 | 1/1966 | Allen | 60/35.6 |
| 3,243,124 | 3/1966 | Lee | 239/127.1 |
| 3,243,126 | 3/1966 | Kurti et al. | 239/265.39 |
| 3,304,865 | 2/1967 | Gungle | 102/49 |
| 3,427,000 | 2/1969 | Scalzo | 415/116 |
| 3,568,929 | 3/1971 | Butter | 239/127.1 |
| 3,694,883 | 10/1972 | Olcott | 29/157 C |
| 3,742,704 | 7/1973 | Adelizzl et al. | 60/39.31 |
| 3,929,289 | 12/1975 | Kardon et al. | 239/265.11 |
| 4,011,718 | 3/1977 | Asplund | 60/39.31 |
| 4,114,368 | 9/1978 | Davis et al. | 60/39.16 |
| 4,173,120 | 11/1979 | Grosjean et al. | 415/115 |
| 4,379,677 | 4/1983 | Hallinger et al. | 415/116 |
| 4,522,557 | 6/1985 | Bouiller et al. | 415/116 |
| 4,643,636 | 2/1987 | Libertini et al. | 415/138 |
| 4,817,970 | 4/1989 | Krauss | 277/25 |
| 4,883,405 | 11/1989 | Walker | 415/137 |

*Primary Examiner*—John T. Kwon

*Attorney, Agent, or Firm*—Jerome C. Squillaro; David L. Narciso

[57] ABSTRACT

An air transfer assembly for a gas turbine engine is provided. The assembly transfers temperature control air from an annular plenum to an annular manifold through an air transfer tube interposed therebetween. The air transfer tube prevents temperature control air leakage even though it is permitted to slide between limits set by an air transfer bushing assembly and a manifold cup formed in the annular manifold. The air transfer bushing is removable and is installed in an aperature in an outer support. The manifold cup is formed in the annular manifold.

20 Claims, 3 Drawing Sheets

AIR TRANSFER BUSHING

The U.S. Government has rights in this invention pursuant to Contract No. F33657-84-C-2011 awarded by the U.S. Department of the Air Force.

BACKGROUND OF INVENTION

1. Field of the Invention

This invention relates, in general, to gas turbine engines and, more particularly, to means for providing an annular temperature control air supply to turbine sections, especially turbine nozzles and turbine blades.

2. Description of the Prior Art

A gas turbine engine of the type anticipated in this invention is described in U.S. Pat. Nos. 4,187,054 and 4,214,851, commonly assigned herewith and included herein by reference, includes a fan powered by a low pressure turbine (LPT), a low pressure compressor (LPC), sometimes called a booster, that is also powered by the LPT, a high pressure compressor (HPC) powered by a high pressure turbine (HPT) and a combustor. The combustor is supplied with fuel that is mixed with compressed air from the HPC and ignited to produce hot combustion gas. As the hot combustion gas expands axially out of the gas turbine engine, it impinges first on the HPT and second on the LPT. The HPT transfers some of the combustion energy to the HPC for compressing air used in generating the combustion gas. The LPT extracts some more energy from the combustion gas and uses it to power the fan and the LPC. The fan generates thrust and the LPC provides partially compressed air to the HPC. The remaining energy contained in the combustion gas exits the gas turbine engine and also provides thrust. The fan generally provides most of the thrust.

During normal operation of the gas turbine engine, combustion gas is produced that can reach very high temperatures, typically in excess of 2000° F. which would degrade the strength of the materials, typically metal, used to construct a gas turbine engine if steps were not taken to reduce the material temperature. The present state of the art uses various cooling methods to prevent components from reaching the temperature of the combustion gas. The cooling method anticipated in the present invention extracts air from the HPC and reroutes it past the combustor to the HPT and the LPT sections. Nonrotating blades, called either stator blades or a nozzle, are located between the rotating blades of the HPT and the LPT to efficiently direct the combustion gas to the LPT blades where energy is extracted from the combustion gas. All parts of the HPT and the LPT must be efficiently cooled to prevent material degradation. The need to use the compressed air from the HPC for cooling reduces the efficiency of the gas turbine engine, so it is desirous to provide a cooling system that does not extract more air from the HPC than is necessary to perform the cooling function.

Air transfer tubes, also known as spoolies, are presently used to dispense temperature control air from an annular air supply to an annular turbine nozzle formed of segmented turbine nozzle sections. The temperature control air is supplied from a bleed system connected to a HPC section of the engine. The temperature control air is fed to an annular supply system located around a turbine section and having one side formed, in part, from an annular nozzle support. There are segmented turbine nozzle sections, each having its own manifold that provides temperature control air to the center of the nozzle blades in that section. In order to supply the temperature control air to the manifolds on the segmented nozzle sections, there is at least one air transfer tube that conducts air to the manifold. Each air transfer tube can be interference fit at the manifold and at the annular nozzle support to prevent temperature control air leakage. The air transfer tubes are permitted to slide between slide stops as the turbine nozzle section expands and contracts relative to the annular temperature control air supply manifold. Presently, an air transfer bushing is spot-welded into an aperture in the annular support and has an interior surface where a circumferential groove or key is located to act as a retaining ring seat. A spring-loaded retaining ring engages the key and forms a slide stop to prevent the air transfer tube from traveling past the end of the bushing. A problem arises because multiple temperature cycles between ambient air temperatures and combustion air temperatures of the engine create stress concentrations at the spot welds on the bushing which then act as initiation sites for cracks that propagate to the surrounding structure. The cracks are very difficult and expensive to repair because of their location in the engine. A method to eliminate the welds, to make the air transfer assembly tolerant to the cycling between temperature extremes experienced in a gas turbine engine and to make the bushings replaceable has been devised.

The present invention eliminates the welds and permits the air transfer tube to be replaced. The present invention also provides improved performance and minimizes installation and maintenance costs.

Accordingly, it is an object of this invention to eliminate welds from a gas turbine engine air transfer assembly.

It is a further object of this invention to provide a gas turbine engine having an air transfer assembly that is replaceable.

It is a further object of this invention to provide a gas turbine engine having an air transfer assembly that is easily produced and maintained.

SUMMARY OF THE INVENTION

In carrying out this invention, in one form thereof, an air transfer bushing assembly for a gas turbine engine, including an air transfer tube is, interposed between an annular plenum and an annular manifold. The annular plenum interfaces with an air transfer bushing assembly that holds one end of the air transfer tube. The annular manifold is adapted to hold the other end of the air transfer tube. The air transfer tube is permitted to slide in response to relative motion between the outer support and the annular manifold. Leakage of temperature control air is prevented by an interference fit at each end of the air transfer tube. On one end of the bushing, there is a hook formed on an outer circumference and a series of slots that engage the outer support when expanded by the insertion of a sleeve. The other end of the bushing has a key that receives a retaining ring that prevents disengagement of the air transfer bushing assembly.

In a preferred embodiment, the air transfer bushing has an annular flange that is located medially along the axis of the bushing. During installation, the air transfer bushing is inserted in an aperture in the annular support to a depth that causes the annular flange to abut an outer surface of the outer support. A sleeve is inserted coaxially inside the bushing and expands the slotted ends out radially causing the hook to engage an inner surface of the outer support. The sleeve is prevented from disengaging during engine operation by the retaining ring and a washer. The bushing assembly can be removed later by compressing the retaining ring and removing the washer and the sleeve.

The air transfer tube provides an air transfer conduit that is tolerant to the dimensional variations between the plenum and the manifold. These variations are caused by temperature differences and stresses that are normal in the engine. One end of the air transfer tube is interference fit in a cup-shaped structure incorporated in the manifold that is attached to a segmented turbine nozzle section. The other end of the air transfer tube is circumferentially aligned around the gas turbine engine with the air transfer bushing and is interference fit into the sleeve. Both ends of the air transfer tube are permitted to slide between mechanical limits or slide stops incorporated along each end. The air transfer tube, thereby, allows temperature control air to pass from the annular plenum to the manifold substantially without leakage even when the plenum and manifold expand or contract relative to each other.

BRIEF DESCRIPTION OF THE DRAWINGS

The novel features of the invention are set forth with particularity in the appended claims. The invention, itself, both as to organization and method of operation, together with further objects and advantages thereof, may best be understood by reference to the following description taken in conjunction with the accompanying drawings in which:

DESCRIPTION OF THE PREFERRED EMBODIMENTS

Figure 1:
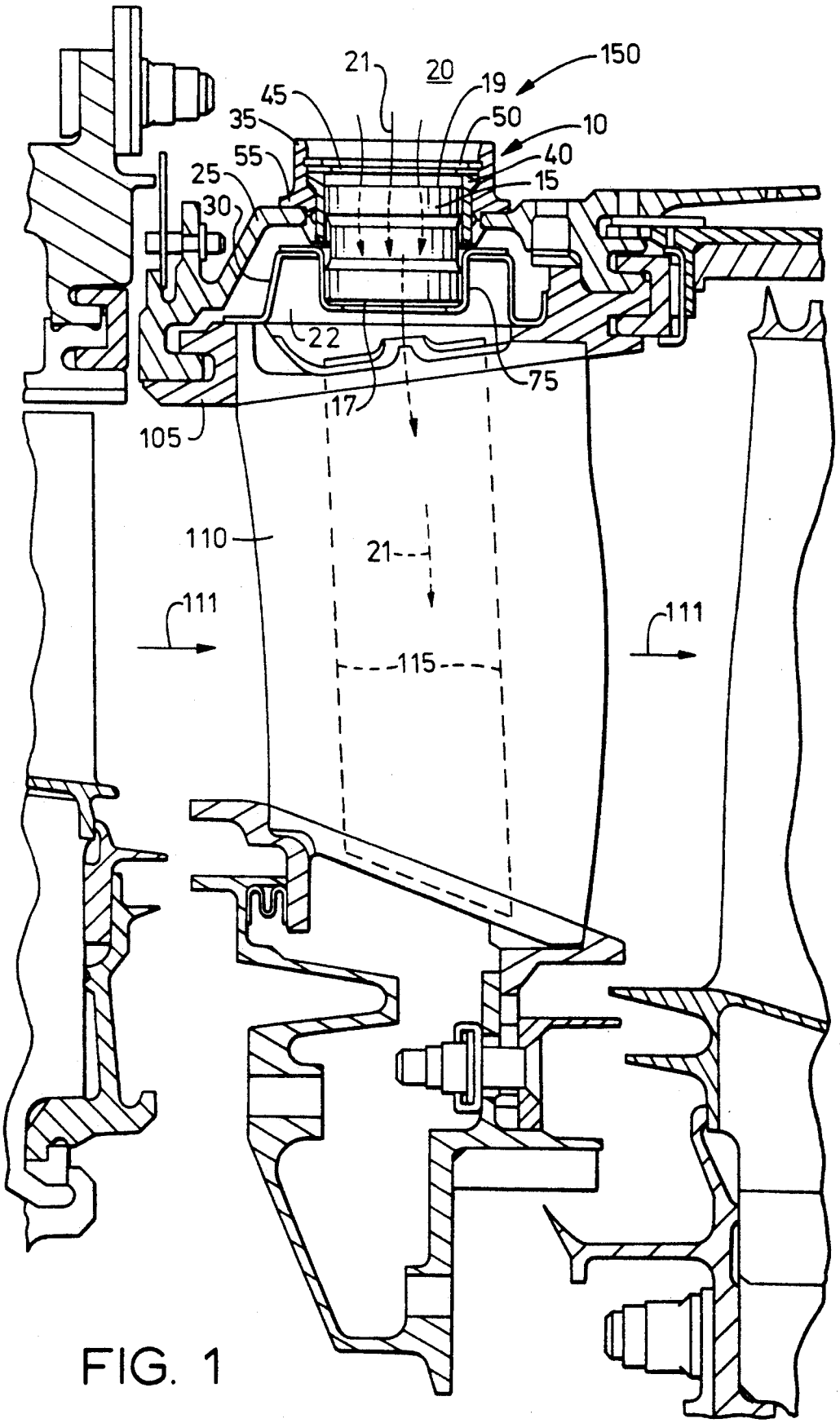
FIG. 1 illustrates a cut-away section of a turbine nozzle section of a gas turbine engine including an air transfer assembly.

Referring now to the figures wherein like reference numerals have been used throughout to designate like parts. FIG. 1 shows a cut-away section of a low pressure turbine (LPT) 150 of an axial flow gas turbine engine (not shown). The LPT section 150 is oriented in a generally radial direction from or perpendicular to the combustion gas flow 111 and the engine axis (also not shown). Temperature control air 21 from plenum 20 flows to hollow section 115 through air transfer tube 15 and manifold cavity 22. Air transfer bushing assembly 10 fixedly engages outer support 25 and slideably engages distal end 19 of air transfer tube 15. Air transfer bushing assembly 10 can be replaced if desired. Proximal end 17 of air transfer tube 15 slideably engages manifold 30. Manifold 30 is integrally connected to nozzle outer band 105 and forms part of a manifold cavity 22 that is in flow communication with hollow section 115. Temperature control air 21 from plenum 20 flows to hollow section 115 without leakage when the outer support 25 moves relative to nozzle outer band 105. Air transfer tube 15 provides a flow conduit that accommodates the relative movement between outer support 25 and manifold 30, because it is slideably engaged at both of its ends 19, 17, respectively.

Figure 2:
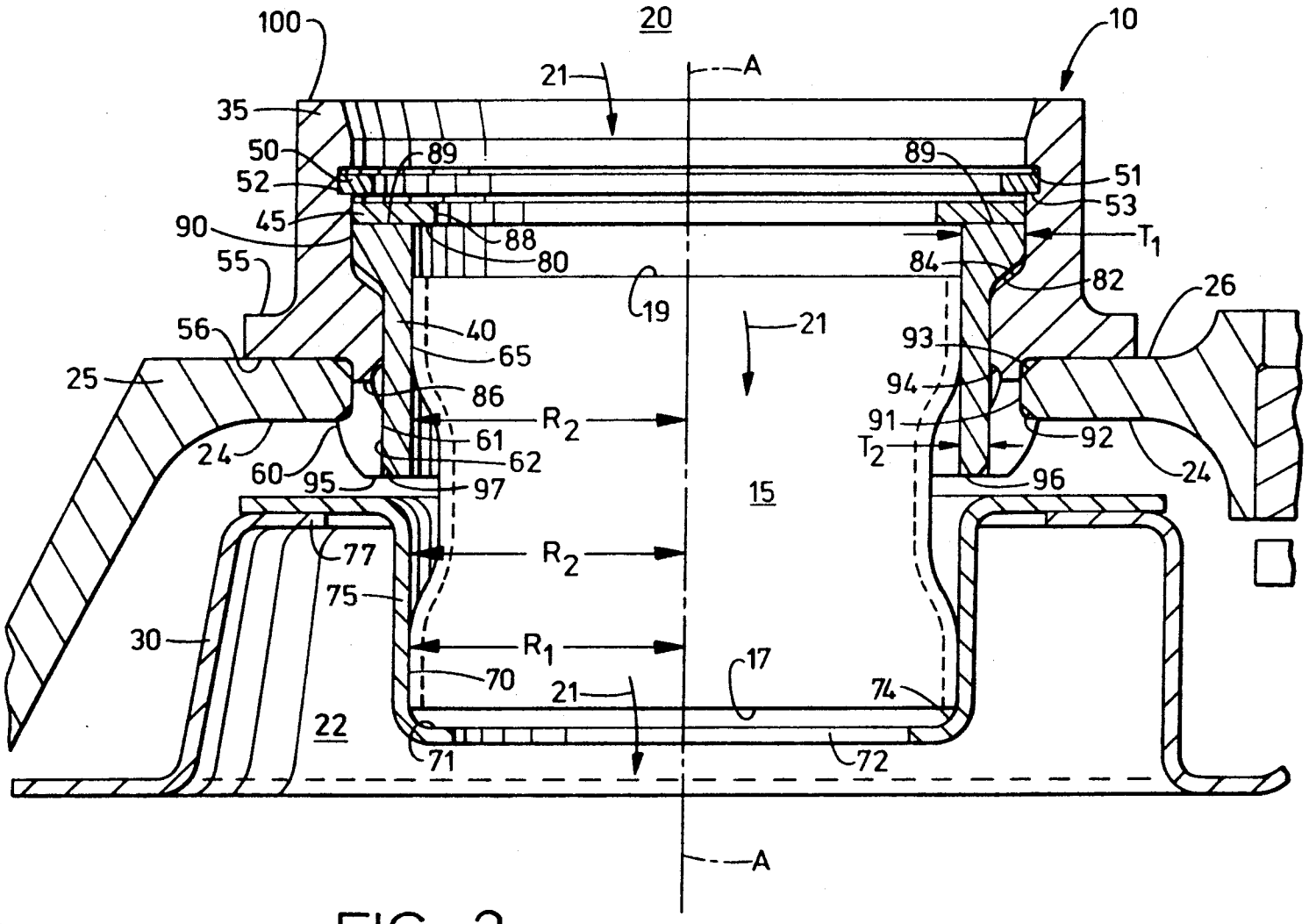
FIG. 2 illustrates a cross section of an air transfer bushing assembly.

FIG. 2 illustrates a detailed cross section of air transfer bushing assembly 10, that is shown fully assembled. Temperature control air 21 from plenum 20 passes to manifold cavity 22 through air transfer tube 15. Proximal end 17 of air transfer tube 15 slideably engages manifold cup 75 and is interference fit at 70. An interference fit is created by sizing the outer radial dimension R1 of proximal end 17 of air transfer tube 15 to be minimally larger than inner radius R2 of sleeve 40 and manifold cup 75 yet still permit sliding motion along an axis A—A which is generally perpendicular to the axis of the axial flow gas turbine engine (not shown). It should be understood by one skilled in the art that, at the installation temperature, the minimal difference between R1 and R2 will depend on the overall dimensions of air transfer tube 15, sleeve 40, and manifold cup 75, and that R1 and R2 will be within the following limits:

$$0 \leqq R_1 - R2 \leqq 0.004 \text{ inch},$$

when R1 is approximately 0.5 inch. At normal operating temperatures, the overall dimensions as described above will vary depending on the thermal properties of the materials used to construct the air transfer assembly and are generally chosen such that air transfer tube 15 will be free to slide in response to motion between annular outer support 25 and manifold 30 while maintaining a tight fit that will minimize cooling air loss. Air transfer tube 15 is prevented from sliding beyond limit point 74 at bottom 71 of manifold cup 75 by axial abutment at limit point 74. Manifold cup 75 is connected to manifold 30 by a compression weld or other connection means at 77.

Distal end 19 of air transfer tube 15 slideably engages air transfer bushing assembly 10. Air transfer bushing assembly 10 is comprised of sleeve 40, bushing 35, retaining ring 50 and washer 45. Air transfer bushing assembly 10 releaseably engages aperture 91 in outer support 25. Proximal end 95 of bushing 35 has a series of slots 85 (shown in FIG. 3) located around its circumference that permit hook 60 to move toward or away from axis A—A for installation or removal. Aperture 91 has an outer bevel 93 and an inner bevel 92 that facilitate the installation and operation of air transfer bushing assembly 10. Air transfer bushing 35 is generally tubular in shape and is generally symmetrical about axis A—A. Air transfer bushing 35 has an annular flange 55 that is located medially along axis A—A and distal from termination location 86. Flange 55 is generally uniform in shape, is substantially parallel to the engine axis (not shown) and extends out radially from axis A—A. Proximal end 95 of air transfer bushing 35 has a hook 60 that extends radially outward from axis A—A and is adapted to engage inner surface 24 of outer support 25. Inner surface 24 is substantially parallel to the engine axis (not shown) and to outer surface 26 of outer support 25. Together outer surface 26 and inner surface 24 form a substantially flat and parallel mating surface that is seated between inner flange surface 56 and hook 60 respectively when sleeve 40 is installed. Outer surface 62 of sleeve 40 engages inner surface 61 on air transfer bushing 35 during installations and causes hook 60 to engage inner surface 24 thereby seating air transfer bushing 35 in aperture 91. Distal end 100 of air transfer bushing 35 is in flow communication with plenum 20 and has a circumferential groove 52, also referred to as a key, that has a top surface 51 and a bottom surface 53. Groove 52 is sized to receive retaining ring 50. Retaining ring 50 is spring-loaded and is removable from groove 52.

Sleeve 40 has top end 89 and bottom end 96. Sleeve 40 is tubular in shape and generally axially symmetric about axis A—A. Sleeve wall thickness T1 is greater along top 89 than at tube wall thickness T2 along bottom 96. A conical surface 82 on sleeve 40 provides a smooth annular transition between thickness T1 of the top end 89 and thickness T2 of the bottom end 96 and acts as a stop during installation and operation. Bottom end 96 of sleeve 40 has a circumferential bevel 97 that facilitates insertion in bushing 35.

At installation and still referring to FIG. 2, bevel edge 97 of sleeve 40 engages inner surface 61 on air transfer bushing 35 in a force fit and causes hook 60 on the air transfer bushing 35 to expand and to engage inner surface 24 of outer support 25. Sleeve 40 is installed properly when there is axial and mating abutment between surface 82 on sleeve 40 and mating surface 84 on air transfer bushing 35. Sleeve 40 is prevented from unintentional dissociation from bushing 35 by axial abutment of sleeve 40 with washer 45 that is interposed between sleeve 40 and retaining ring 50. Retaining ring 50, likewise, abuts top surface 51 of groove 52 in air transfer bushing 35. Any axial load is thereby transferred to outer support 25 through air transfer bushing 35 when hook 60 engages inner surface 24 of outer support 25. Washer 45 has opening 88 that can be selected to meter the amount of temperature control air passing from plenum 20 to air transfer tube 15. Air transfer tube 15 slide travel is controlled by axial abutment with washer 45 at 80. Distal end 19 of air transfer tube 15 is also interference fit in sleeve 40 at point 65 (shown in FIG. 2). The interference fit at both ends of air transfer tube 15 minimizes air leakage yet permits relative movement between sleeve 40 and manifold cup 75.

At installation, as illustrated in FIG. 2, air transfer bushing 35 is inserted through aperture 91 in outer support 25. Hook 60 passes through aperture 91. Sleeve 40 is then inserted axially in air transfer bushing 35. Sleeve 40 is inserted into air transfer bushing 35 and is advanced until surface 82 abuts surface 84 on air transfer bushing 35. Air transfer tube 15 and washer 45 are installed and retaining ring 50 is compressed and fit into groove 52. At this point, sleeve 40 and air transfer tube 50 are prevented from disengaging from air transfer bushing 35 by axial abutment with washer surface 80. Air transfer tube 15 is then free to slide between inner surface 80 of washer 45 and bottom 74 of manifold cup 75.

Figure 3:
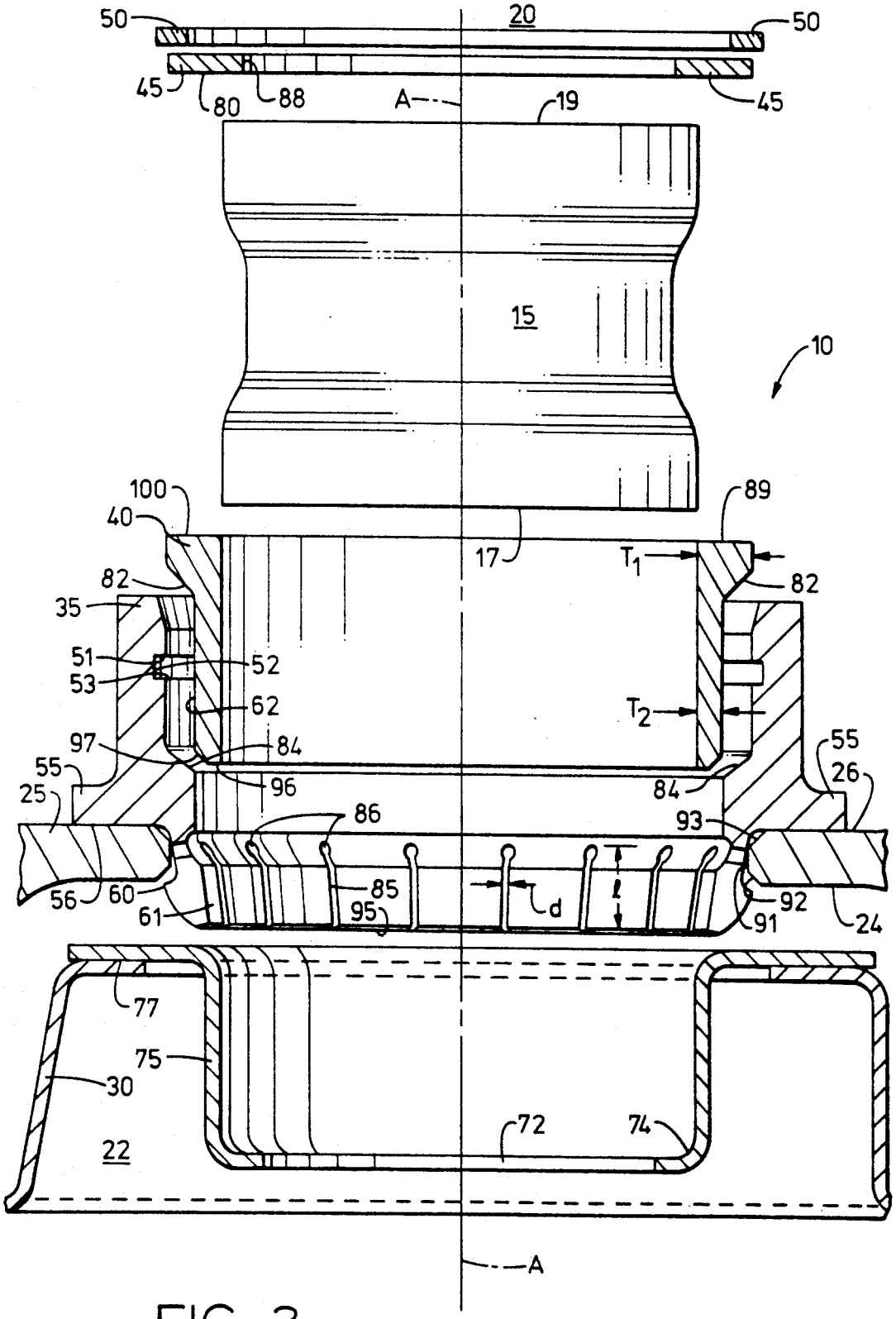
FIG. 3 illustrates a cross section of a disassembled air transfer bushing assembly.

FIG. 3 illustrates a cross section of air transfer bushing assembly 10 shown disassembled. Air transfer bushing 35 is inserted through aperture 91 in outer support 25. Hook 60 on proximal end of air transfer bushing 35 is not yet engaged with inner surface 24 of outer support 25. Flange 55 abuts outer surface 26 of outer support 25 at 56 which indicates that air transfer bushing 35 is properly installed in aperture 91. Sleeve 40 is shown partially inserted into air transfer bushing 35. As sleeve 40 is inserted farther, edge 97 on sleeve 40 engages inner surface 61 of hook 60 and causes hook 60 to expand radially outward to engage inner surface 24, thereby seating air transfer bushing 35 in outer support 25. Hook 60 can expand radially outward because proximal end 95 of bushing 35 has a series of slots 85 located around its circumference. Each slot 85 is generally uniform in width d and length 1 and extends from proximal end 95 in a general direction parallel to axis A—A medially to a termination location 86 that is similar for each slot 85. Further, insertion of sleeve 40 causes transition surface 82 on sleeve 40 to abut mating surface 84 on air transfer bushing 35, which indicates proper installation of sleeve 40. Air transfer tube 15 is inserted in sleeve 40 until proximal end 17 engages manifold cup 75 at 74.

Washer 45 is inserted and retaining ring 50 is installed in slot 52. Termination location 86 of slot 85 has an increased radius which distributes the stress encountered by hook 60 during installation of sleeve 40 over a larger area thereby preventing initiation of cracks at this site. The shape of termination location 86 is generally smooth and rounded and small radii or sharp corners are avoided. A minimum diameter of termination location 86 is generally greater than twice the width d of slot 85.

While this invention has been disclosed and described with respect to preferred embodiments thereof, it will be apparent to those skilled in the art that various changes and modifications may be made therein without departing from the spirit and scope of the invention as set forth in the appended claims.

We claim:

1. An air transfer assembly for use in a gas turbine engine for providing temperature control air to engine parts substantially without leakage comprising:

a) an annular plenum;

b) at least one air transfer tube having a proximal end and a distal end, said distal end coupled in flow communication with said annular plenum;

c) an annular support distally located from the engine parts and adapted to receive and slideably engage said distal end of said air transfer tube;

d) an annular manifold proximally located to the engine parts and adapted to receive and slidably engage said proximal end of said air transfer tube, said proximal end being in flow communication with the engine parts;

e) replaceable means for confining said transfer tube between said annular support and said manifold forming a slideable conduit for control air passage between said plenum and said manifold, said confining means comprising a bushing replaceably installed in said annular support so as to prevent stress concentrations from forming in said annular support; and f) means for preventing control air leakage; and g) a sleeve coaxially mated with said bushing and adapted to slideably receive said distal tube end.

2. An air transfer assembly in accordance with claim 1, wherein said confining means is adapted to function when there is relative motion between said annular support and said annular manifold.

3. An air transfer assembly in accordance with claim 1, wherein said annular support forms part of said annular plenum.

4. An air transfer assembly in accordance with claim 1, including a plurality of air transfer tubes.

5. An air transfer assembly in accordance with claim 4, wherein said plurality of said air transfer tubes are uniformly spaced.

6. An air transfer assembly in accordance with claim 1, wherein said annular plenum is located adjacent to a gas turbine nozzle section.

7. An air transfer assembly in accordance with claim 1, wherein said replaceable confining means further comprises:

a) said bushing having a first end adapted to removably engage said annular support and a second end having a key;

b) a flat washer inserted in said bushing second end; and c) a retaining ring adapted to removably engage said key wherein said flat washer is interposed between said sleeve and said retaining ring such that said washer is retained in said bushing second end and prevents unintentional dissociation of said sleeve from said bushing and limits tube travel.

8. An air transfer assembly in accordance with claim 7, wherein said leakage prevention means comprises an interference fit between said sleeve and said distal tube end and between said adapted annular manifold and said proximal tube end.

9. An air transfer assembly in accordance with claim 1, wherein said replaceable confining means further comprises:

a) said bushing being replaceably installed in said annular support at a first end and having a second end including a key; and b) a retaining ring adapted to engage said key thereby providing a slide stop for said distal tube end.

10. A replaceable air transfer bushing assembly for use in a gas turbine engine for providing temperature control air to engine parts without leakage and that has a support having an outer surface and an inner surface and having an aperture and that has an air transfer tube, comprising:

a) an aperture insertable axial bushing, generally tubular in shape, having proximal and distal ends and a radially extending annular flange located medially between said proximal end and said distal end;

b) a plurality of slots having a generally uniform width each extending from said proximal end of said bushing in a generally axial direction to circumferentially similar termination locations proximal to said annular flange;

c) means for clamping said proximal bushing end to said support, whereby said clamping means prevents stress concentrations from forming in said support;

d) a key on said bushing being located distally from said annular flange;

e) a sleeve adapted to insertably mate with said bushing and slideably engage said transfer tube; and f) means for releaseably securing said sleeve in said bushing.

11. A replaceable air transfer bushing assembly in accordance with claim 10 wherein said clamping means comprises an annular hook formed on said proximal bushing end such that when said bushing is inserted through said aperture of said support, said flange abuts said outer surface and said hook radially expands to engage said inner surface of said support when said sleeve is insertably mated with said bushing.

12. A replaceable air transfer bushing assembly in accordance with claim 10 wherein said securing means comprises a flat washer and a retaining ring adapted to removably engage said key thereby providing an axial abutment means for said sleeve.

13. A replaceable air transfer bushing assembly in accordance with claim 10 including means for providing an axial slide stop for said transfer tube.

14. A replaceable air transfer bushing assembly in accordance with claim 13 wherein said slide stop means comprises said flat washer and said retaining ring.

15. A replaceable air transfer bushing assembly in accordance with claim 10 including means to substantially eliminate crack initiation sites from said slot termination location.

16. A replaceable air transfer bushing assembly in accordance with claim 15 wherein said elimination means comprises an arcuate hole intersecting said termination location and having a diameter nearly twice said slot width.

17. A replaceable air transfer bushing assembly in accordance with claim 10 including means for preventing control air leakage.

18. A replaceable air transfer bushing assembly in accordance with claim 17 wherein said prevention mean comprises an interference fit between said transfer tube and said sleeve.

19. A replaceable air transfer bushing in accordance with claim 18, including:

means for slideably engaging said transfer tube:

means for limiting said transfer tube slide travel; and means for preventing control air leakage.

20. A replaceable air transfer bushing in accordance with claim 19 wherein said prevention means comprises an interference fit between said transfer tube and said engaging means.

* * * * *